US012631123B2

(12) United States Patent
Sun et al.

(10) Patent No.: US 12,631,123 B2
(45) Date of Patent: May 19, 2026

(54) DEEP PEAK-SHAVING AND EFFICIENT OPERATION CONTROL SYSTEM AND METHOD FOR THERMAL POWER UNIT WITH VARIABLE TURBINE SPEED

(71) Applicant: ZHEJIANG BAIMA LAKE LABORATORY CO., LTD., Zhejiang (CN)

(72) Inventors: Shien Sun, Zhejiang (CN); Shenghui Liu, Zhejiang (CN); Zhouyang Luo, Zhejiang (CN); Runchao Qiu, Zhejiang (CN); Peidong Ji, Zhejiang (CN)

(73) Assignee: Zhejiang Baima Lake Laboratory Co., Ltd., Zhejiang (CN)

( * ) Notice: Subject to any disclaimer, the term of this patent is extended or adjusted under 35 U.S.C. 154(b) by 0 days.

(21) Appl. No.: 19/198,112

(22) Filed: May 4, 2025

(65) Prior Publication Data

US 2025/0264034 A1 Aug. 21, 2025

Related U.S. Application Data

(63) Continuation-in-part of application No. PCT/CN2024/083692, filed on Mar. 26, 2024.

(30) Foreign Application Priority Data

Oct. 16, 2023 (CN) ..... 202311332776.9

(51) Int. Cl.
*F01D 17/10* (2006.01)
*F01D 15/10* (2006.01)
(Continued)

(52) U.S. Cl.
CPC ..... *F01D 17/10* (2013.01); *F01D 15/10* (2013.01); *F01D 17/06* (2013.01); *F01D 21/003* (2013.01)

(58) Field of Classification Search
CPC ..... F01D 21/02; F01D 17/10; F01D 17/146; F01D 17/06
See application file for complete search history.

(56) References Cited

U.S. PATENT DOCUMENTS 4,015,430 A * 4/1977 Braytenbah ..... F01K 7/24 376/241
4,201,924 A * 5/1980 Uram ..... F01K 23/108 290/40 R
(Continued)

FOREIGN PATENT DOCUMENTS

CN 205744007 11/2016
CN 112879109 6/2021
(Continued)

OTHER PUBLICATIONS

Translation of CN116104589 (Year: 2025).*
"International Search Report (Form PCT/ISA/210) of PCT/CN2024/083692," mailed on Jul. 1, 2024, pp. 1-4.

*Primary Examiner* — Courtney D Heinle
*Assistant Examiner* — Cameron A Corday
(74) *Attorney, Agent, or Firm* — JCIPRNET

(57) ABSTRACT

A deep peak-shaving and efficient operation control system for a thermal power unit with variable turbine speed, including a turbine body, and an inlet main steam valve connected to the turbine body. One end of the inlet main steam valve is connected to the turbine body by an inlet pipe behind the inlet main steam valve, and the other end of the inlet main steam valve is connected to an inlet pipe before the inlet main steam valve. The inlet main steam valve is connected to an inlet main steam valve actuator. The turbine body is coaxially and directly connected to a generator, and the generator is connected to a power grid by a four-quadrant frequency converter system via a transformer.

10 Claims, 4 Drawing Sheets

(51) Int. Cl.
*F01D 17/06* (2006.01)
*F01D 21/00* (2006.01)

(56) References Cited

U.S. PATENT DOCUMENTS

| | | | | | |
|---|---|---|---|---|---|
| 4,271,673 | A * | 6/1981 | Skala | F01D 17/08 | 60/660 |
| 4,329,592 | A * | 5/1982 | Wagner | F01K 23/101 | 290/40 R |
| 5,042,246 | A * | 8/1991 | Moore | F02C 7/268 | 60/788 |
| 12,366,174 | B2 * | 7/2025 | Ouchi | F01D 25/16 | |
| 2005/0012339 | A1 * | 1/2005 | Mikhail | H02P 9/105 | 290/44 |
| 2021/0033025 | A1 * | 2/2021 | Abdurrahman | F01D 25/12 | |

FOREIGN PATENT DOCUMENTS

| | | |
|---|---|---|
| CN | 114837763 | 5/2023 |
| CN | 116104589 | 5/2023 |
| CN | 117685066 | 3/2024 |
| JP | 2020002931 | 1/2020 |

* cited by examiner

DEEP PEAK-SHAVING AND EFFICIENT OPERATION CONTROL SYSTEM AND METHOD FOR THERMAL POWER UNIT WITH VARIABLE TURBINE SPEED

CROSS-REFERENCE TO RELATED APPLICATION

This is a continuation-in-part application of International Application No. PCT/CN2024/083692, filed on Mar. 26, 2024, which claims the priority benefits of China Application No. 202311332776.9, filed on Oct. 16, 2023. The entirety of each of the above-mentioned patent applications is hereby incorporated by reference herein and made a part of this specification.

TECHNICAL FIELD

The present invention relates to the technical field of power industry, and especially relates to a deep peak-shaving and efficient operation control system and method for a thermal power unit with variable turbine speed.

DESCRIPTION OF RELATED ART

A turbine is a rotary power machine that converts the energy of steam into mechanical work, is also known as a steam turbine, is mainly used as a prime mover for power generation, and can also directly drive various pumps, fans, compressors, ship propellers, and the like. The internal power of a turbine is: $P_i=D_0\Delta h_t\eta_i=B\cdot D_0$. When initial parameters remain unchanged or do not change significantly, the internal power of a turbine depends on the inlet flow $D_0$ and the enthalpy drop $\Delta h_t$, while the enthalpy drop $\Delta h_t$ mainly depends on the inlet pressure $P_0$. Therefore, to achieve deep peak shaving of a unit and respond to large-scale load changes, the power of a turbine needs to be adjusted, mainly by adjusting the inlet flow $D_0$ and the inlet pressure $P_0$. Commonly used steam distribution methods include throttle steam distribution, nozzle steam distribution, and bypass steam distribution. By throttle steam distribution, steam is throttled inside a control valve, resulting in significant energy-saving loss and a significant reduction in ideal enthalpy drop, and leading to a decrease in the efficiency of a turbine. By nozzle steam distribution, a control stage and various high-pressure stages experience significant temperature changes and high thermal stress under varying operating conditions, resulting in poor load adaptability. Bypass steam distribution may result in throttling loss, cannot be used independently, and can be used only in combination.

The Chinese patent document with the publication number CN114837763B, published on May 25, 2023, discloses a flexible control system and working method for a thermal power unit integrated with a steam energy accumulator, where exhaust steam from a high-pressure cylinder is injected into an intermediate-pressure steam accumulator for steam storage during low load operation or load reduction of the unit. Exhaust steam from an intermediate-pressure cylinder is injected into a low-pressure steam accumulator for steam storage, and working fluids in the intermediate-pressure cylinder and a low-pressure cylinder are reduced by storing steam, to achieve low load operation or rapid load reduction of the unit. When the load is increased in the unit, the steam in the intermediate-pressure steam accumulator is released as heating steam for a high-pressure heater and a deaerator, and the steam in the low-pressure steam accumulator is released as heating steam for a first low-pressure heater and a second low-pressure heater, thereby reducing steam extraction from a turbine and achieving rapid load increase in the unit.

The above flexible control system and working method for a thermal power unit has the disadvantage that the working fluids in the intermediate-pressure cylinder and low-pressure cylinder are reduced by storing steam to achieve low load operation or rapid load reduction of the unit, resulting in significant steam throttling loss and a significant reduction in ideal enthalpy drop, and leading to a decrease in the efficiency of a turbine.

SUMMARY OF THE INVENTION

An objective of the present invention is to solve the problems of significant throttling loss or cycle thermal efficiency loss, as well as complex control in existing control systems and methods of thermal power units, and provide a deep peak-shaving and efficient operation control system and method for a thermal power unit with variable turbine speed, which achieves no throttling of a main throttle valve by adjusting the turbine speed and the opening of the main throttle valve, and has the advantage of no or less throttling loss under full-load conditions.

The technical solutions adopted by the present invention to solve the above technical problems are as follows. In a first aspect: a deep peak-shaving and efficient operation control system for a thermal power unit with variable turbine speed includes a turbine body, and further includes an inlet main steam valve connected to the turbine body. One end of the inlet main steam valve is connected to the turbine body by an inlet pipe behind the inlet main steam valve, and the other end of the inlet main steam valve is connected to an inlet pipe before the inlet main steam valve. The inlet main steam valve is connected to an inlet main steam valve actuator, and the opening of the inlet main steam valve is controlled by control signals sent by an electronic controller. The turbine body is coaxially and directly connected to a generator, and the generator is connected to a power grid by a four-quadrant frequency converter system via a transformer. The turbine body is provided with a turbine speed measuring device to provide feedback on the turbine speed to the electronic controller.

By using the technical solution of the first aspect, the inlet main steam valve can quickly adjust the turbine load. A stator of the generator is directly connected to the power grid by the four-quadrant frequency converter system via a transformer system, to achieve constant voltage and frequency of the generator. The generator changes the flow capacity of the turbine body by adjusting the speed, so that the inlet flow of the turbine matches the load, to ultimately achieve no throttling of the main throttle valve, and allow the turbine to operate under optimal conditions.

In the first aspect, preferably, the inlet main steam valve is connected to the inlet main steam valve actuator, and the inlet main steam valve actuator is connected to an EH oil supply system and the electronic controller. Specifically, the opening of the inlet main steam valve is controlled by the inlet main steam valve actuator, the action of the inlet main steam valve actuator is driven by the EH oil supply system, open and close control signals are controlled by the electronic controller, and the inlet main steam valve is connected to the turbine body to control the inlet flow of the turbine body and quickly adjust the turbine load. Then, the flow capacity of the turbine body is changed by adjusting the speed, so that the inlet flow of the turbine matches the load.

Thus, power adjustment requirements can be quickly met by throttling (reducing the opening of the main steam valve or a main steam control valve), the turbine speed is reduced by a speed control system, and the opening of the main steam valve or main steam control valve is gradually restored to reduce throttling loss and achieve a dynamic balance.

In the first aspect, preferably, the turbine body is provided with the turbine speed measuring device and a speed limiting device, and signals generated by the turbine speed measuring device are connected to a first tachometer signal branch and a second tachometer signal branch. Specifically, when the turbine speed exceeds the maximum safe speed, the speed measuring device transmits a signal to the speed limiting device to control the turbine speed within the maximum safe speed. Thus, the turbine speed remains within the maximum safe speed, which not only improves the efficiency but also ensures the reliability and safety of the operation control system.

In the first aspect, preferably, a circuit breaker is further connected between the generator and the power grid, the circuit breaker is connected to a filter, and the generator regulates the generator speed and the turbine speed by controlling torque currents. Specifically, the filter is arranged behind the circuit breaker to reduce harmonic oscillations in the power grid. Thus, the efficiency of power generation, transmission, and consumption can be improved, the heat, vibration, and noise of the turbine can be reduced, and the service life of the turbine can be extended. The turbine speed is the same as the generator speed, and can be indirectly controlled by controlling the torque current of the generator by a four-quadrant frequency converter to control the generator speed.

In the first aspect, preferably, the first tachometer signal branch is connected to an overspeed emergency trip system, and the second tachometer signal branch is connected to the electronic controller. Specifically, the signals generated by the turbine speed measuring device are divided into two branches, the second tachometer signal branch is connected to the electronic controller to control the EH oil supply, and the first tachometer signal branch is connected to the overspeed emergency trip system to achieve emergency shutdown. Thus, the electronic controller controls the EH oil supply, that is, the open and close control signals are controlled by the electronic controller, and the main steam valve can be controlled to be opened at any intermediate position to proportionally adjust the inlet flow to meet the needs. The overspeed emergency trip system achieves emergency shutdown, to achieve better safety and reliability.

In the first aspect, preferably, control signals for the inlet main steam valve actuator are obtained by basic operations of the electronic controller. Specifically, the inlet main steam valve actuator is used to automatically adjust the opening of the inlet main steam valve, and the control signals for the inlet main steam valve actuator are obtained by basic operations of the electronic controller and sent to control the inlet main steam valve actuator, thereby achieving automatic adjustment of the opening of the inlet main steam valve. Thus, the flow capacity of the turbine body is changed by adjusting the speed, so that the inlet flow of the turbine matches the load, and the throttling loss is reduced.

In the first aspect, preferably, the parameters of the basic operations include turbine speed and load setpoint. Specifically, the turbine speed, load setpoint, and various feedback signals of the turbine are subjected to basic operations by the electronic controller, and signals are sent to control the inlet main steam valve actuator, thereby achieving automatic adjustment of the opening of the inlet main steam valve. Thus, the flow capacity of the turbine body is changed by adjusting the speed, so that the inlet flow of the turbine matches the load, and the throttling loss is reduced.

In a second aspect, a deep peak-shaving and efficient operation control method for a thermal power unit with variable turbine speed is applied to the operation control system in the first aspect, and includes the following steps: S1: starting a rotor to a safe operating speed range; S2: adjusting a load to a target load and maintaining the opening of the inlet main steam valve to match the turbine speed; S3: determining whether the inlet main steam valve is fully open, if not, gradually increasing the opening of the inlet main steam valve, reducing the turbine speed while maintaining the target load unchanged until the inlet main steam valve is fully open; and if yes, keeping up the operation; and S4: turning off the turbine: first reducing the main steam pressure to lower the load of the generator, and then gradually reducing the opening of the inlet main steam valve until the turbine is safely and stably shut down.

Using the technical solution of the second aspect, when the load is adjusted, first the inlet flow of the turbine may be quickly changed to meet the load adjustment requirements of the turbine. Then, by adjusting the turbine speed and the opening of the main throttle valve, no throttling (or less throttling) of the main throttle valve is finally achieved, and the turbine operates under optimal conditions. The turbine no longer operates at a constant rated speed, but at different speeds to adjust the optimal flow passage rate of the turbine, thereby reducing throttling loss and improving the flow passage efficiency of pipelines and the turbine of a thermal power unit under partial load conditions.

In the second aspect, preferably, S1 includes: S1.1: gradually opening the inlet main steam valve until the rotor rotates; S1.2: reducing the opening of the inlet main steam valve and checking whether any noise is listened from the turbine, if yes, shutting down the turbine immediately, and if not, proceeding to the next step; S1.3: increasing the opening of the inlet main steam valve and maintaining the speed for warm-up; and S1.4: gradually increasing the opening of the inlet main steam valve until the turbine exceeds a critical speed, and continuing to increase the turbine speed to the safe operating speed range. Specifically, starting the rotor to the safe operating speed range, i.e., start-up operation control, refers to a process of accelerating the rotor from a stationary (or barring) state to the safe operating speed range and gradually increasing the load to the rated load. First, steam parameters for starting and turning the turbine and the main steam temperature are set, and then the inlet main steam valve is slowly opened. When the rotor rotates, the opening of the inlet main steam valve is immediately reduced and a certain speed is maintained. The internal sound is carefully listened for any abnormal sounds inside. When everything is normal, the opening of the inlet main steam valve is increased to maintain the speed for warm-up. During the warm-up, temperature rise of a bearing and expansion and vibration of various parts need to be noticed. After the unit is confirmed to be normal, the opening of the inlet main steam valve is gradually increased. After the turbine safely exceeds the critical speed, the turbine speed is continued to be increased, an asynchronous generator is latched and loaded, and a turbogenerator unit enters the safe operating speed range.

In the second aspect, preferably, in S2, if the current load exceeds the target load, the load needs to be reduced, the opening of the inlet main steam valve is reduced, the power generation load of the generator is reduced to the target load, and the turbine speed is lowered until the inlet flow of the turbine matches the load. Specifically, after the turbogenerator unit stabilizes at a certain load, when the load needs to be reduced, the opening of the inlet main steam valve is reduced, the power generation load of the generator is reduced, the turbine speed is lowered, and the turbine load reaches the target load. If the turbine speed exceeds the maximum safe speed during the start-up, load adjustment, shutdown, and other processes of the turbine, the turbine speed is reduced by the speed limiting device or emergency shutdown is performed by an emergency trip device.

The deep peak-shaving and efficient operation control system and method for a thermal power unit with variable turbine speed according to the present invention uses a frequency converter to decouple the turbine speed from the frequency of the power grid, adjusts the opening of the main steam control valve of the turbine according to the power generation load rate, and comprehensively utilizes throttling steam admission and inlet pressure adjustment, thereby enabling the turbine to operate at different speeds under different load conditions, and achieving efficient and flexible operation of the turbine.

The present invention has the following beneficial effects: The turbine quickly and flexibly responds to load changes to make adjustment and maintain frequency synchronization by using an inlet main steam valve variable speed system and a generator variable frequency system, and has no or less throttling loss under full-load conditions; the optimal flow passage rate of the turbine is adjusted by using different speeds, thereby reducing throttling loss and improving the flow passage efficiency of pipelines and the turbine of a thermal power unit under partial load conditions; and the turbine speed is reduced by the speed limiting device or emergency shutdown is performed by the emergency trip device, and the safety and reliability are better.

Features described and/or illustrated for one implementation may be used in the same or similar manner in one or more other implementations, and combined with features in other implementations, or may replace features in other implementations. It should be emphasized that the term "comprise/include" when used herein refers to the existence of features, whole unit, steps, or components, but does not exclude the existence or attachment of one or more other features, whole unit, steps, or components.

DESCRIPTION OF THE EMBODIMENTS

Specific implementations of the technical solutions of the present invention will be further described below through the embodiments with reference to the accompanying drawings.

The terms used in the present application are for the purpose of describing specific embodiments only, and are not intended to limit the present application. The singular forms "a/an", "the", and "this" used in the present application and the appended claims may also include plural forms unless the contexts clearly indicate other meanings. It should also be understood that the term "and/or" used herein refers to and includes any and all possible combinations of one or more of the associated listed items.

Embodiment 1

Figure 1:
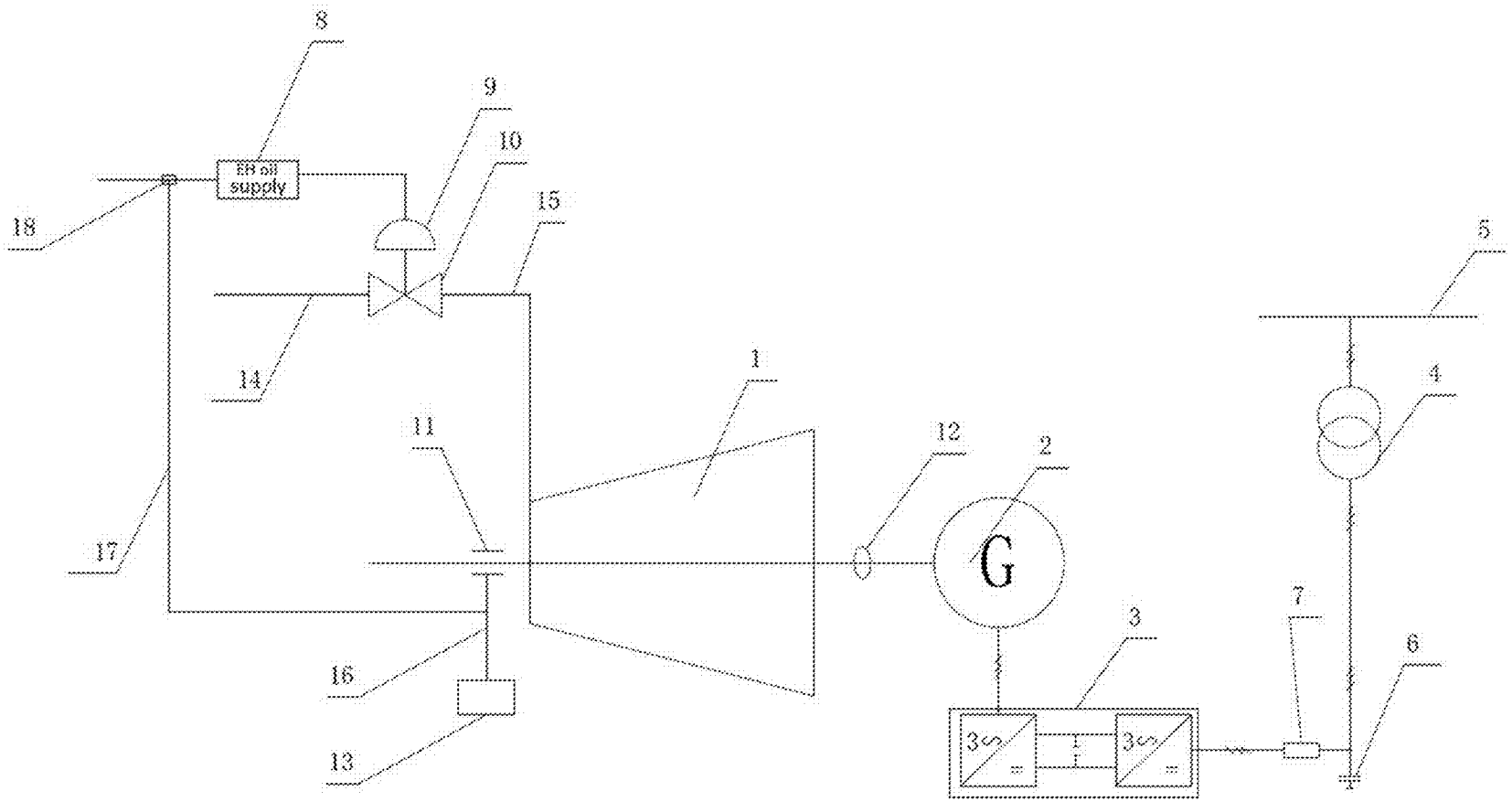
FIG. 1 is a structural diagram of a deep peak-shaving and efficient operation control system for a thermal power unit with variable turbine speed according to the present invention.

In Embodiment 1 shown in FIG. 1, the present invention provides a technical solution: A deep peak-shaving and efficient operation control system for a thermal power unit with variable turbine speed includes a turbine body 1, and further includes an inlet main steam valve 10 connected to the turbine body 1. One end of the inlet main steam valve 10 is connected to the turbine body 1 by an inlet pipe 15 behind the inlet main steam valve, and the other end of the inlet main steam valve is connected to an inlet pipe 14 before the inlet main steam valve. The inlet main steam valve 10 is connected to an inlet main steam valve actuator 9, and the opening of the inlet main steam valve 10 is controlled by control signals sent by an electronic controller 18. The turbine body 1 is further coaxially and directly connected to a generator 2, and the generator 2 is connected to a power grid 5 by a four-quadrant frequency converter 3 system via a transformer 4. The turbine body 1 is provided with a turbine speed measuring device 11 to provide feedback on the turbine speed to the electronic controller 18.

FIG. 1 is a structural diagram of a deep peak-shaving and efficient operation control system for a thermal power unit with variable turbine speed according to the present invention, illustrating the specific structure and components of the operation control system. The thermal power unit includes but is not limited to a unit with a rated power greater than 100 MW.

As shown in FIG. 1, in this embodiment, the turbine body 1 is connected to the generator 2, and a stator of the generator 2 is directly connected to the power grid 5 by the four-quadrant frequency converter 3 system via a transformer system. Electricity is generated by a turbine at variable speeds; the frequency of the electricity needs to be converted to be synchronous with the power grid 5 by a frequency conversion system, and the voltage of the electricity is stepped up; and then the electricity is connected into the power grid 5. The frequency conversion system is additionally arranged to meet the grid connection requirements, and achieve constant voltage and frequency of the generator 2. A circuit breaker 7 is also connected between the generator 2 and the power grid 5, the circuit breaker 7 is connected to a filter 6, and the filter 6 is arranged behind the circuit breaker 7 to reduce harmonic oscillations in the power grid 5. Thus, the efficiency of power generation, transmission, and consumption can be improved, the heat, vibration, and noise of the turbine can be reduced, and the service life of the turbine can be extended.

As shown in FIG. 1, in this embodiment, the operation control system includes the turbine body 1, and the turbine body 1 is connected to the inlet main steam valve 10. One end of the inlet main steam valve 10 is connected to the turbine body 1 by an inlet pipe 15 behind the inlet main steam valve, and the other end of the inlet main steam valve is connected to an inlet pipe 14 before the inlet main steam valve. The inlet main steam valve 10 is connected to an inlet main steam valve actuator 9, and the opening of the inlet main steam valve 10 is controlled by the inlet main steam valve actuator 9. The inlet main steam valve 10 controls the inlet flow of the turbine body 1 to quickly adjust the turbine load. Then, the flow capacity of the turbine body 1 is changed by adjusting the speed, so that the inlet flow of the turbine matches the load. That is, the inlet flow corresponding to the flow capacity precisely meets the load requirements, and throttling loss is avoided.

As shown in FIG. 1, in this embodiment, the inlet main steam valve actuator 9 is connected to an electro hydraulic (EH) oil supply system 8 and the electronic controller 18, the action of the inlet main steam valve actuator 9 is driven by the EH oil supply system, and open and close control signals are controlled by the electronic controller 18. The inlet main steam valve actuator 9 is used to automatically adjust the opening of the inlet main steam valve 10, the electronic controller 18 performs basic operations on the turbine speed, load setpoint, and various feedback signals of the turbine to generate control signals for the inlet main steam valve actuator, and the signals are sent to control the inlet main steam valve actuator 9, thereby achieving automatic adjustment of the opening of the inlet main steam valve 10. The inlet main steam valve actuator 9 can quickly respond to the signals from the electronic controller 18, control the inlet main steam valve 10 to be opened fixedly at any intermediate position, and continuously adjust the inlet flow to meet the needs.

As shown in FIG. 1, in this embodiment, the turbine body 1 is provided with the turbine speed measuring device 11 and a speed limiting device 12. When the turbine speed exceeds the maximum safe speed, the speed measuring device transmits a signal to the speed limiting device 12 to control the turbine speed within the maximum safe speed. Signals generated by the turbine speed measuring device 11 are connected to a first tachometer signal branch 16 and a second tachometer signal branch 17. The first tachometer signal branch 16 is connected to an overspeed emergency trip system 13, and the second tachometer signal branch 17 is connected to the electronic controller 18. The signals generated by the turbine speed measuring device 11 are divided into two branches, the second tachometer signal branch 17 is connected to the electronic controller 18 to control the EH oil supply, and the first tachometer signal branch 16 is connected to the overspeed emergency trip system 13 to achieve emergency shutdown.

In this embodiment, the function of the four-quadrant frequency converter is not only to convert the electricity of different frequencies generated by the generator to a frequency that conforms to the voltage and connect the electricity into the power grid, but also to control the torque current of the generator, thereby controlling the generator speed. Also, because the generator is coaxially connected to the turbine, the turbine speed is indirectly controlled.

Specifically, based on a vector control theory, the torque of the generator can be controlled by controlling the current of the four-quadrant frequency converter connected to the generator, and the generator speed can be controlled by controlling the torque. The basic principle of vector control is to decompose a stator current vector of a motor into a d-axis current component (exciting current) that generates a magnetic field and a q-axis current component (torque current) that generates torque, which are controlled separately. In the embodiment, the generator speed is controlled using the torque current of the q-axis current component. Specifically, the relation between speed and current is shown in the following equations:

$$T_e = \frac{3}{2} P \psi_f i_q$$

$$P_e = T_e \omega$$

where $T_e$ is the generator torque, P is the number of pole pairs, $\psi_f$ is a flux linkage generated by a permanent magnet, $i_q$ is the q-axis current component, $P_e$ is the generator power, and $\omega$ is the speed (both the generator speed and the turbine speed).

By the deep peak-shaving and efficient operation control system for a thermal power unit with variable turbine speed in this embodiment, the turbine quickly and flexibly responds to load changes to make adjustment and maintain the frequency synchronization by using a variable speed system and a variable frequency system, and has no or less throttling loss under full-load conditions. The turbine speed is quickly changed by means of throttling regulation, and the output voltage, frequency, and power of the generator 2 are also changed. The voltage and frequency connected to the power grid 5 are kept constant by the four-quadrant frequency converter 3 and other frequency conversion systems. When the turbine speed exceeds a certain safe maximum speed, the speed limiting device 12 or an overspeed protection device needs to be used.

Embodiment 2

Figure 2:
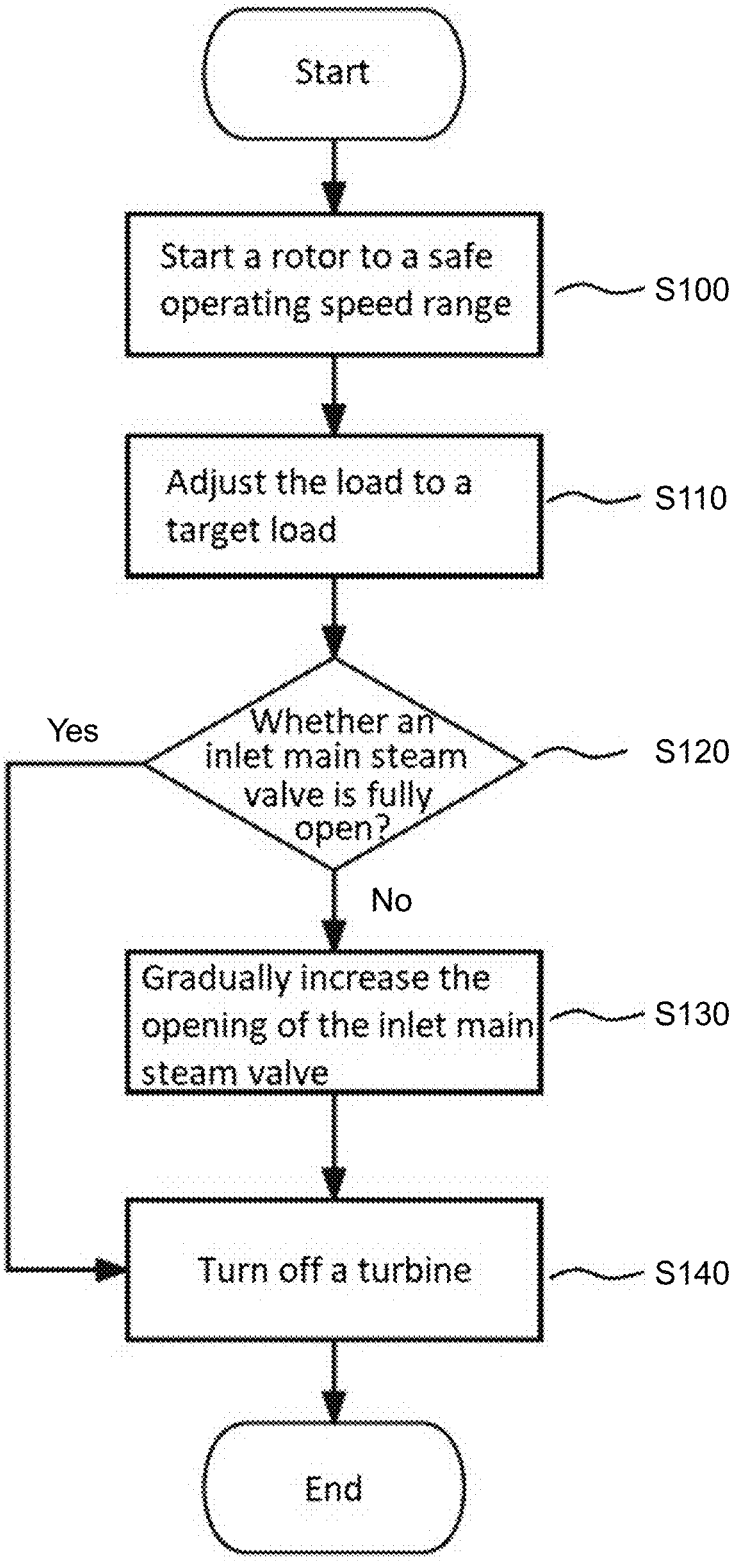
FIG. 2 is a schematic flowchart of a deep peak-shaving and efficient operation control method for a thermal power unit with variable turbine speed according to the present invention.
Figure 3:
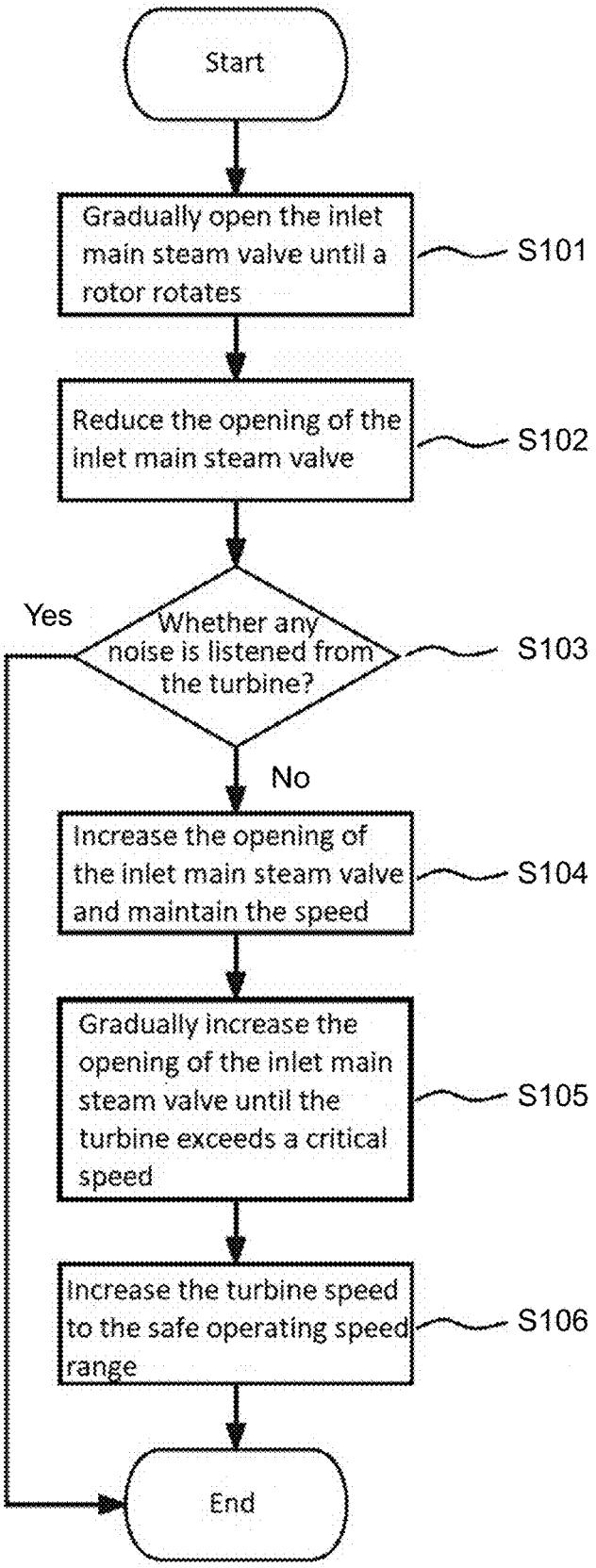
FIG. 3 is a schematic flowchart illustrating the starting a rotor to a safe operating speed range in the deep peak-shaving and efficient operation control method for a thermal power unit with variable turbine speed according to the present invention.
Figure 4:
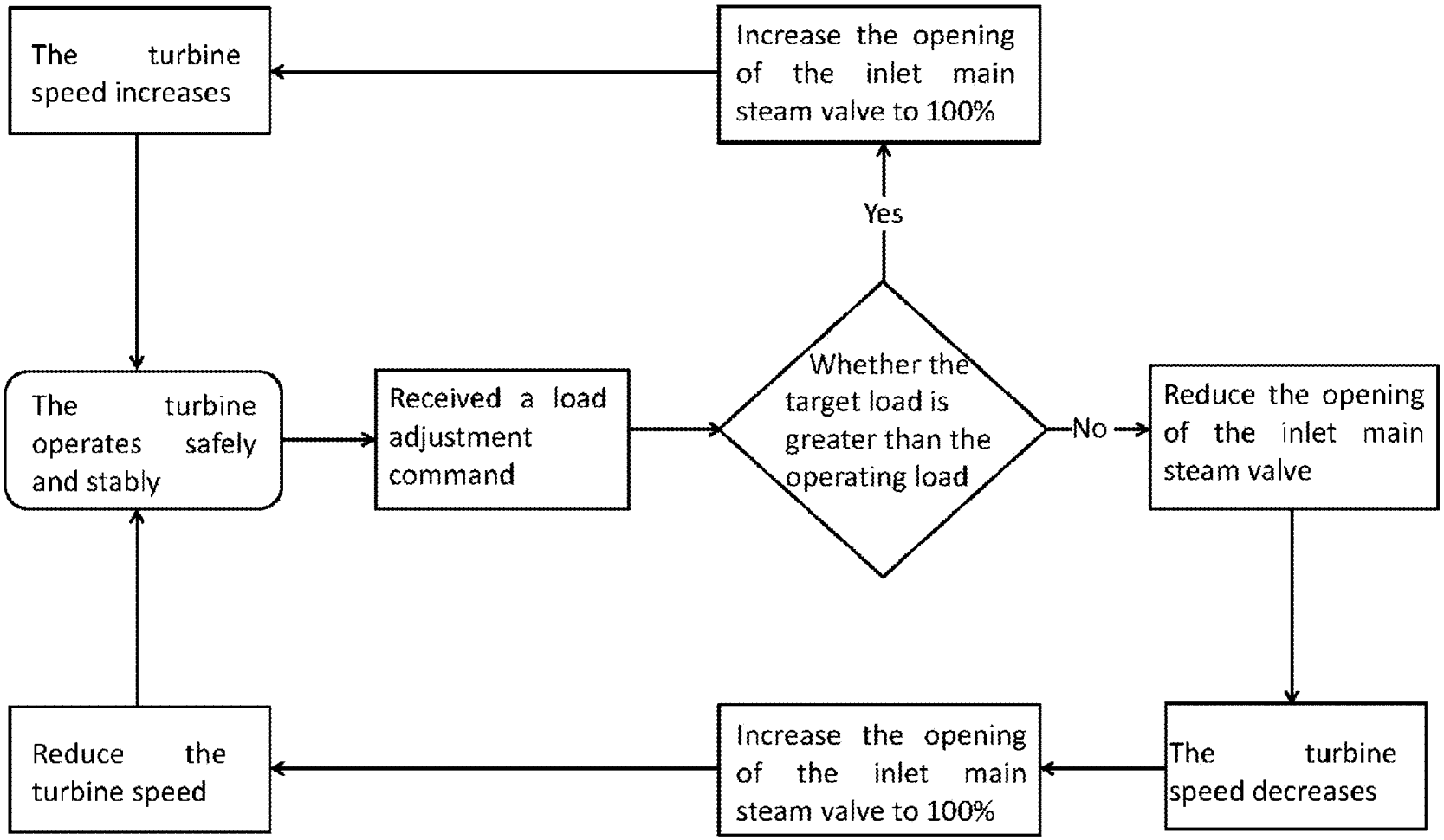
FIG. 4 is a schematic load control diagram of the deep peak-shaving and efficient operation control method for a thermal power unit with variable turbine speed according to the present invention.

In Embodiment 2 as shown in FIG. 2 to FIG. 4, the present invention provides a technical solution: A deep peak-shaving and efficient operation control method for a thermal power unit with variable turbine speed, is applied to the operation control system in Embodiment 1, and includes the following steps: S1: a rotor is started to a safe operating speed range; S2: the load is adjusted to a target load, and the opening of the inlet main steam valve is maintained to match the turbine speed; S3: whether the inlet main steam valve is fully open is determined; if not, the opening of the inlet main steam valve is gradually increased, the turbine speed is reduced while the target load is maintained unchanged until the inlet main steam valve is fully open; and if yes, the operation is kept up; and S4: the turbine is turned off: first the main steam pressure is reduced to lower the load of the generator, and then the opening of the inlet main steam valve is gradually reduced until the turbine is safely and stably shut down.

In this embodiment, taking a 300 MW turbogenerator 2 unit as an example, under rated conditions, the steam parameters of the inlet pipe 14 before the inlet main steam valve are 16.7 MPa and 536° C.; the critical speed of the rotor of the turbine body 1 is 1500 r/min; and the safe operating speed is 2000-8000 r/min. The turbogenerator 2 unit can operate stably at 25-100% full speed, and the safe operating load of the turbine is 25-100% of the rated load. In this embodiment, the operation control of the turbine includes start-up operation control, load adjustment operation control, stable load operation control, and shutdown operation control.

FIG. 2 is a schematic flowchart of a deep peak-shaving and efficient operation control method for a thermal power unit with variable turbine speed according to the present invention, illustrating the specific process of a service platform integration method, and specifically introducing how to perform service platform integration. The flowchart as shown in FIG. 2 includes the following steps.

S100: A rotor is started to a safe operating speed range. Starting the rotor to the safe operating speed range, i.e., start-up operation control, refers to a process of accelerating the rotor from a stationary (or barring) state to the safe operating speed range and gradually increasing the load to the rated load. In this embodiment, FIG. 3 is a schematic flowchart of starting the rotor to the safe operating speed range, as shown in the flowchart in FIG. 3, which includes the following S101 to S106.

S101: The inlet main steam valve is gradually opened until the rotor rotates. In this embodiment, the steam parameters for starting and turning the turbine are generally set to 5 MPa, the main steam temperature is 370° C. or higher, and the inlet main steam valve 10 is slowly opened until the rotor rotates.

S102: The opening of the inlet main steam valve 10 is reduced. In this embodiment, when the rotor rotates, the opening of the inlet main steam valve 10 is immediately reduced and a certain speed is maintained. In this embodiment, the speed is 100 r/min.

S103: Whether the turbine has a noise is checked, if yes, the process is directly ended; and if not, S104 is performed. In this embodiment, the sound inside the turbine is carefully listened to check for any abnormal sound. If any abnormal sound is listened, the turbine is immediately shut down for inspection.

S104: The opening of the inlet main steam valve 10 is increased and the speed is maintained. In this embodiment, when everything is normal, the opening of the inlet main steam valve 10 is increased to maintain the speed at 500 r/m for warm-up for 15-20 min. During the warm-up, temperature rise of a bearing and expansion and vibration of various parts need to be noticed.

S105: The opening of the inlet main steam valve 10 is gradually increased until the turbine exceeds a critical speed. In this embodiment, after the unit is confirmed to be normal, the opening of the inlet main steam valve 10 is gradually increased. After the turbine safely exceeds the critical speed, the turbine speed is continued to be increased to 2000 r/min, and an asynchronous generator 2 is latched and loaded.

S106: The turbine speed is increased to the safe operating speed range. In this embodiment, the turbine speed is increased to a safe operating speed of 2000-8000 r/min.

S110: The load is adjusted to a target load. FIG. 4 is a schematic load control diagram of the deep peak-shaving and efficient operation control method for a thermal power unit with variable turbine speed according to the present invention. As shown in FIG. 4, in this embodiment, load control includes load adjustment operation control and stable load operation control, ultimately for the safe and stable operation of the turbine. When the turbogenerator 2 unit enters the safe operating speed range, the opening of the inlet main steam valve 10 is increased to increase the power generation load of the generator 2, the turbine speed is also increased, and the turbine load reaches the target load. After the turbogenerator 2 unit stabilizes at a certain load, when the load needs to be reduced, the opening of the inlet main steam valve 10 is reduced, the power generation load of the generator 2 is reduced, the turbine speed is lowered, and the turbine load reaches the target load. When the load of the unit is decreased, power adjustment requirements can be quickly met to reach the target load by throttling (reducing the opening of the inlet main steam valve or a main steam control valve), the turbine speed can be reduced by a speed control system, and the opening of the main steam valve or the main steam control valve is gradually restored to reduce throttling loss, achieve a dynamic balance, and make the inlet flow of the turbine match the load. When the load of the unit is increased, the target load can be reached by increasing the opening of the inlet main steam valve or the main steam control valve, the turbine speed can be increased by the speed control system, and the power of the unit is improved by gradually increasing fuel supply and other measures, to achieve a dynamic balance, and make the inlet flow of the turbine match the load.

S120: Whether the inlet main steam valve is fully open is determined, if yes, the turbine is maintained to operate until S140; and if not, S130 is performed. In this embodiment, whether the inlet main steam valve is fully open can be determined by observation.

S130: The opening of the inlet main steam valve 10 is gradually increased. In this embodiment, when the turbine load reaches the target load, if the inlet main steam valve 10 is not fully open and still has throttling loss, the opening of the inlet main steam valve 10 is gradually increased, the load of the generator 2 is maintained unchanged, and the turbine speed is reduced until the inlet main steam valve 10 is fully open to 100%.

S140: The turbine is turned off. In this embodiment, to normally shut down the turbine, first the main steam pressure is reduced to lower the load of the generator 2, and then the opening of the inlet main steam valve 10 is gradually reduced until the turbine is safely and stably shut down. If the turbine speed exceeds the maximum safe speed during the start-up, load adjustment, shutdown, and other processes of the turbine, the turbine speed is reduced by the speed limiting device 12 or emergency shutdown is performed by an emergency trip device.

The deep peak-shaving and efficient operation control method for a thermal power unit with variable turbine speed according to the present invention uses a frequency converter to decouple the turbine speed from the frequency of the power grid 5, adjusts the opening of the main steam control valve of the turbine according to the power generation load rate, and comprehensively utilizes throttling steam admission and inlet pressure adjustment, thereby enabling the turbine to operate at different speeds under different load conditions, and achieving efficient and flexible operation of the turbine. At different generated outputs, the turbine no longer operates at a constant rated speed, but at different speeds to adjust the optimal flow passage rate of the turbine, thereby reducing throttling loss and improving the flow passage efficiency of pipelines and the turbine of a thermal power unit under partial load conditions.

Finally, it should be noted that the above embodiments are used for describing the technical solutions of the present invention only, but are not intended to limit the present invention. Although the present invention is described in detail with reference to preferred embodiments, those of ordinary skill in the art should understand that modifications or equivalent replacements made to the technical solutions of the present invention should be included in the scope of claims of the present invention as long as they do not depart from the purpose and scope of the technical solutions of the present invention.

What is claimed is:

1. A deep peak-shaving and efficient operation control system for a thermal power unit with variable turbine speed, comprising:

a turbine body; and an inlet main steam valve, connected to the turbine body, wherein one end of the inlet main steam valve is connected to the turbine body by an inlet pipe behind the inlet main steam valve, and the other end of the inlet main steam valve is connected to an inlet pipe before the inlet main steam valve, wherein the inlet main steam valve is connected to an inlet main steam valve actuator, and an opening of the inlet main steam valve is controlled by control signals sent by an electronic controller;

wherein the turbine body is further coaxially and directly connected to a generator, the generator is connected to a power grid by a four-quadrant frequency converter system via a transformer, and the turbine body is provided with a turbine speed measuring circuit to provide feedback on a turbine speed to the electronic controller, wherein the generator is configured to change a flow passage rate of the turbine body to achieve no throttling of the inlet main steam valve based on a speed adjustment of the turbine speed.

2. The deep peak-shaving and efficient operation control system according to claim 1, wherein the inlet main steam valve actuator is connected to an EH oil supply system and the electronic controller.

3. The deep peak-shaving and efficient operation control system according to claim 2, wherein the turbine body is further provided with a speed limiting circuit; and signals generated by the turbine speed measuring device are connected to a first tachometer signal branch and a second tachometer signal branch.

4. The deep peak-shaving and efficient operation control system according to claim 1, wherein a circuit breaker is further connected between the generator and the power grid, and the circuit breaker is connected to a filter;

the generator is configured to regulate a generator speed and the turbine speed by controlling torque currents.

5. The deep peak-shaving and efficient operation control system according to claim 3, wherein the first tachometer signal branch is connected to an overspeed emergency trip system; and the second tachometer signal branch is connected to the electronic controller.

6. The deep peak-shaving and efficient operation control system according to claim 2, wherein control signals for the inlet main steam valve actuator are obtained by basic operations of the electronic controller, and parameters of the basic operations comprise the turbine speed and a load setpoint.

7. A deep peak-shaving and efficient operation control method for a thermal power unit with variable turbine speed, applied to an operation control system, the deep peak-shaving and efficient operation control method comprising:

S1: starting a rotor of a turbine to a safe operating speed range;

S2: adjusting a load to a target load and maintaining an opening of an inlet main steam valve to match a turbine speed of the turbine;

S3: determining whether the inlet main steam valve is fully open, if not, gradually increasing the opening of the inlet main steam valve, reducing the turbine speed while the target load is maintained unchanged until the inlet main steam valve is fully open; and if yes, keeping up an operation of the turbine, wherein the turbine is coaxially and directly connected to a generator, and the generator is configured to change a flow passage rate of the turbine to achieve no throttling of the inlet main steam valve based on a speed adjustment of the turbine speed; and S4: turning off the turbine: first reducing a main steam pressure to lower the load of the generator, and then gradually reducing the opening of the inlet main steam valve until the turbine is safely and stably shut down.

8. The deep peak-shaving and efficient operation control method according to claim 7, wherein S1 comprises:

S1.1: gradually opening the inlet main steam valve until the rotor rotates;

S1.2: reducing the opening of the inlet main steam valve and checking whether any noise is listened from the turbine, if yes, shutting down the turbine immediately, and if not, proceeding to the next step;

S1.3: increasing the opening of the inlet main steam valve and maintaining the speed for warm-up; and S1.4: gradually increasing the opening of the inlet main steam valve until the turbine exceeds a critical speed, and continuing to increase the turbine speed to the safe operating speed range.

9. The deep peak-shaving and efficient operation control method according to claim 7, wherein in S2, if a current load exceeds the target load, the load needs to be reduced, the opening of the inlet main steam valve is reduced, a power generation load of the generator is reduced to the target load, and the turbine speed is lowered until an inlet flow of the turbine matches the load.

10. The deep peak-shaving and efficient operation control method according to claim 7, wherein in S2, if a current load is less than the target load, the load needs to be increased, the opening of the inlet main steam valve is increased, a power generation load of the generator is increased to the target load, and the turbine speed is increased until an inlet flow of the turbine matches the load.

* * * * *